US006566802B1

(12) United States Patent
Jeong

(10) Patent No.: US 6,566,802 B1
(45) Date of Patent: May 20, 2003

(54) STRUCTURE OF PANEL FOR FLAT TYPE CATHODE RAY TUBE

(75) Inventor: Seong Han Jeong, Pusan (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 09/705,695

(22) Filed: Nov. 6, 2000

(30) Foreign Application Priority Data

Nov. 6, 1999 (KR) ..... 99/49051

(51) Int. Cl.[7] ..... H01J 31/00
(52) U.S. Cl. ..... 313/477 R; 313/461; 220/2.1 A
(58) Field of Search ..... 313/477 R, 479, 313/480, 473, 461, 408; 220/2.1 A, 2.3 A; 348/821, 823

(56) References Cited

U.S. PATENT DOCUMENTS 5,925,977 A * 7/1999 Sugawara et al. ..... 313/477 R
5,964,364 A * 10/1999 Shimizu et al. ..... 220/2.1 A
RE36,838 E * 8/2000 Sugawara et al. ..... 313/477 R
6,121,723 A * 9/2000 Sugawara et al. ..... 220/2.1 A
6,133,686 A * 10/2000 Inoue et al. ..... 313/477 R
6,236,151 B1 * 5/2001 Murakami et al. ..... 220/2.1 A

FOREIGN PATENT DOCUMENTS

KR 2001063378 * 7/2001

* cited by examiner

*Primary Examiner*—Ashok Patel
(74) *Attorney, Agent, or Firm*—Fleshner & Kim, LLP

(57) ABSTRACT

A structure of a panel for a flat type cathode ray tube having an outer panel surface approximating a completely flat surface and an inner panel surface with a radius of curvature is provided. A difference between a panel thickness at a central part of the panel and a panel thickness at each of the diagonal corner parts of the panel satisfies a condition of $1.7 \leqq T2/T1 \leqq 2.2$, where T1 represents the panel thickness at the central panel part and T2 represents the panel thickness at the diagonal corner panel parts. Further, compressive stresses exhibited at at least one part of the outer panel surface satisfy a condition of $6.0\ \text{MPa} \leqq |\sigma| \leqq 15.0\ \text{MPa}$, where $\sigma$ represents the compressive stresses exhibited at at least one part of the panel. This panel structure can maximize an effect of preventing an in-furnace thermal breakage of the panel.

20 Claims, 5 Drawing Sheets

GENERAL PANEL, WEDGE RATE OF 130%
MAXIMUM OF 52.2 MPa

FLAT PANEL, WEDGE RATE OF 170%
MAXIMUM OF 72.3 MPa

FLAT PANEL, WEDGE RATE OF 180%
MAXIMUM OF 74.3 MPa

FLAT PANEL, WEDGE RATE OF 200%
MAXIMUM OF 93.4 MPa

STRUCTURE OF PANEL FOR FLAT TYPE CATHODE RAY TUBE

BACKGROUND OF THE INVENTION

1. Field of the Invention

The present invention relates to a display panel for a cathode ray tube, and more particularly to a display panel for a cathode ray tube which has a panel structure approximate to a completely-flat panel structure in accordance with a correction of radiuses of curvature at inner and outer surfaces thereof while being capable of reducing a breakage thereof resulting from an in-furnace thermal impact in accordance with an optional variation in the compressive stress distribution exhibited therein.

2. Description of the Related Art

Referring to FIG. 1, an example of a typical cathode ray tube is illustrated. As shown in FIG. 1, the cathode ray tube includes a panel 10 mounted to a front portion of the cathode ray tube and made of a glass material, a shadow mask 12 arranged in rear of the panel 10 and adapted to allow electron beams to be accurately projected onto desired portions of a fluorescent film formed on an inner surface of the panel 10, and a frame 14 for supporting the shadow mask 12. The frame 14 is mounted to the panel 10 by means of stud pins 16 fixed to the panel 10 and springs 18 mounted to the frame 14. The springs 18 are coupled to the stud pins 16, respectively, thereby coupling the frame 14 to the panel 10. The cathode ray tube also includes a funnel 20 coupled to a rear end of the panel 10 at a front end thereof and adapted to maintain the interior of the cathode ray tube in a vacuum state, a cylindrical neck 22 connected to a rear end of the funnel 20 and made of a glass material, and an electron gun (not shown) fitted in the neck 22 and adapted to emit an electron beam. The cathode ray tube further includes an inner shield 26 mounted to a peripheral end of the frame 14 and adapted to shield an external magnetic field, a deflection yoke 28 mounted around the rear end of the funnel 20 and adapted to deflect the electron beam emitted from the electron gun, and a band 30 fitted around jointed portions of the panel 10 and funnel 20.

FIG. 2*a* illustrates the case in which the panel 10 has a panel structure for general screens. In this case, the panel structure of the panel 10 has a certain curvature at an outer surface thereof. FIG. 2*a* illustrates the case in which the panel 10 has a flat panel structure. In the case of FIG. 2*b,* the outer surface of the panel 10 is flat.

In either case, the panel 10 has, at the inner surface thereof, a face part 10*a* provided with a fluorescent film consisting of red, green, and blue dot trios of a fluorescent material to form an effective region for displaying an image, a central part 10*b* arranged at a central coordinate portion of the face part 10*a,* and a skirt part 10*c* arranged around the face part 10*a*. The skirt part 10*c* includes corner parts 10*d* and a seal edge part 10*e* coupled to the funnel 20.

In the general panel structure of FIG. 2*a,* an image displayed onto the screen is viewed in a convex state because of curved inner and outer surfaces of the panel. Furthermore, this panel structure also involves a diffused reflection of external light resulting in an increased fatigue of viewers.

The flat panel structure of FIG. 2*b* can eliminate the problems involved in the panel structure of FIG. 2*a* in that it is flat, thereby avoiding a phenomenon that an image displayed onto the screen is viewed in a convex state, and that it reduces the fatigue of viewers. However, this flat panel structure involves a thermal breakage of the panel resulting from an insurance of structural strength for the shadow mask.

To this end, in order to improve the surface strength of the panel 10 having the flat panel structure, a proposal has been made, in which a compressive stress layer is formed at the surface of the panel to avoid a thermal breakage of the panel due to heat generated during the manufacture of the cathode ray tube.

Meanwhile, a method has also been proposed, in which a high stress is temporarily generated at the panel 10. An example of such a method is a method for cooling the panel 10 to an annealing point or less. In accordance with this method, a thermal distribution is exhibited in the panel not only in a thickness direction, but also in a plane direction perpendicular to the thickness direction, due to a thermal distribution resulting from a three-dimensional structure of the panel and a cooling of the panel by air.

In particular, the cooling of the panel 10 at the corner parts 10*d* in accordance with a general cooling process tends to be carried out at a slow rate, as compared to the cooling of the panel 10 at the central part 10*b,* due to an influence of the three-dimensional structure of the panel 10.

In accordance with this process, a higher temperature gradient and a high stress are exhibited in the thickness direction at a higher cooling rate of the panel 10. Under this condition, the stress exhibited at the corner parts 10*d* of the panel 10 is less than that exhibited at the central part 10*b*.

Accordingly, the panel 10, which is physically reinforced, exhibits a stress distribution in which the reinforced stress exhibited around each corner part 10*d* is lower than that exhibited at the central part 10*b,* and the reinforce stress exhibited at the inner surface of the face part 10*a* is lower than that exhibited at the outer surface of the face part 10*a*. Due to such a stress distribution, the panel 10 exhibits a degraded effect of preventing a thermal breakage from occurring during the manufacture of the cathode ray tube.

The conventional panel has a certain curvature at inner and outer surfaces thereof so that they have a desired structural strength, as shown in FIG. 2. By virtue of such a curvature, the panel also has, at each panel corner part 10*d* thereof, a thickness corresponding to 130% or less of the thickness of the central part 10*b*.

As a result, the panel involve a greatly reduced in-furnace thermal breakage. In the case of a panel having a radius of curvature corresponding to 50,000 mm or more at the outer surface thereof while having a certain radius of curvature at the inner surface thereof, which is so called a "flat panel", as shown in FIG. 2*b,* however, the thickness of each panel corner part 10*d* should be 170% or more of the thickness of the central part 10*b* in order to maximize the structural strength of the shadow mask 12. Due to such an abrupt increase in thickness, the panel 10 has a very undesirable structure in association with a breakage thereof, even though it makes it possible to maintain a desired strength of the shadow mask 12.

In order to solve this problem, it is necessary to considerably compress the surface of the panel 10. However, the in-furnace thermal breakage problem cannot be completely solved only using this method.

This is because an abrupt increase in thermal stress, which may result in an insolvable in-furnace thermal breakage is exhibited when the thickness difference, that is, the wedge rate, between the central part 10*b* and corner part 10*d* of the panel 10 is 230% or more. In the manufacture of a cathode ray tube, such a high thermal stress results in an in-furnace thermal breakage of the cathode ray tube. In order to minimize such a phenomenon, it is necessary to make a huge investment in order to achieve an improvement in furnace temperature. A great reduction in productivity is also involved, which results in a great increase in manufacturing costs.

The most effective method for preventing an in-furnace thermal breakage is to minimize the stress difference among the central part 10*b,* face part 10*a,* corner parts 10*d,* and seal edge part 10*e* of the panel 10.

Korean Patent Laid-open Publication No. 98-71757 discloses a technique in which compressive stresses are optionally provided at desired portions of a panel, respectively, so that the panel can be designed to have a reduced thickness while ensuring a security against explosions, in order to solve problems involved in conventional cathode ray tube designs in which a panel is designed to have an increased thickness at the face and peripheral parts thereof to achieve an enhancement in strength while ensuring a security against explosions.

However, there is no disclosure associated with schemes for providing a stress distribution capable of controlling an in-furnace breakage occurring in the manufacture of cathode ray tubes in the case using panels having an increased thickness, as in flat panels. Furthermore, where a high compressive stress of 16 MPa or mote is maintained, the stress difference between the central and corner parts of the panel is greatly increased due to the panel structure used. In this case, an in-furnace thermal breakage occurs very easily.

In order to obtain a panel structure having an appropriate stress distribution to exhibit a high resistance to a thermal breakage, accordingly, it is necessary to minimize the stress difference among the central part 10*b,* face part 10*a,* corner parts 10*d,* and seal edge part 10*e* of the panel 10.

SUMMARY OF THE INVENTION

Therefore, an object of the invention is to provide a display panel for a cathode ray tube which has a flat panel structure having, at face and skirt parts thereof, optionally-controlled compressive stresses respectively applied in accordance with a specific physical reinforcement scheme, thereby being capable of maximizing an effect of preventing an in-furnace thermal breakage of the panel.

In accordance with one aspect, the present invention provides a display panel for a cathode ray tube having an outer panel surface approximate to a complete flat surface, and an inner panel surface with a desired radius of curvature, wherein: a difference between a panel thickness at a central part of the panel and a panel thickness at each of diagonal corner parts of the panel is determined to satisfy a condition of "$1.7 \leqq T2/T1 \leqq 2.3$", where, "T1" represents the panel thickness at the central panel part, and "T2" represents the panel thickness at the diagonal corner panel part; and compressive stresses exhibited at respective parts of the panel on the outer panel surface of the panel is determined to satisfy a condition of "$6.0\ \text{MPa} \leqq |\sigma| \leqq 15.0\ \text{MPa}$", where, "$\sigma$" represents the compressive stresses exhibited at respective parts of the panel.

Preferably, the compressive stress exhibited at the central panel part is preferably determined to satisfy a condition of "$10.0\ \text{MPa} \leqq |\sigma_{C/C}| \leqq 15.0\ \text{MPa}$", where, "$\sigma_{C/C}$" represents the compressive stress exhibited at the central panel part. The compressive stress exhibited at a seal edge part of the panel is preferably determined to satisfy a condition of "$6.0\ \text{MPa} \leqq |\sigma_{S/E}| \leqq 9.0\ \text{MPa}$", where, "$\sigma_{S/E}$" represents the compressive stress exhibited at the seal edge panel part. Preferably, the compressive stress exhibited at a seal edge part of the panel and the compressive stresses exhibited at respective portions of a face part of the panel extending in short-side and long-side directions are determined to satisfy conditions of "$0.8 \leqq |\sigma_{S/E}/\sigma_{Min}| \leqq 1.4$" and "$0.8 \leqq |\sigma_{S/E}/\sigma_{Maj}| \leqq 1.4$", where, "$\sigma_{S/E}$" represents the compressive stress exhibited at the seal edge panel part, and "$\sigma_{Min}$" and "$_{Maj}$" represent respective compressive stresses exhibited at the short-side and long-side portions of the face panel part. Preferably, the compressive stress exhibited at a mold match line of the panel on the outer surface of the panel and those exhibited at respective portions of a face part of the panel extending in short-side and long-side directions are determined to satisfy conditions of "$0.35 \leqq |\sigma_{M/M}/\sigma_{Min}| \leqq 0.65$" and "$0.35 \leqq |\sigma_{M/M}/\sigma_{Maj}| \leqq 0.65$", where, "$\sigma_{M/M}$" represents the compressive stress exhibited at the mold match line of the panel on the outer surface of the panel, and "$\sigma_{Min}$" and "$\sigma_{Maj}$" represent respective compressive stresses exhibited at the short-side and long-side portions of the face panel part. Membrane stresses exhibited at respective parts of the panel are preferably determined to satisfy a range from 30 $kg/cm^2$ to 90 $kg/cm^2$.

In accordance with another aspect, the present invention provides a display panel for a cathode ray tube having an outer panel surface approximate to a complete flat surface, and an inner panel surface with a desired radius of curvature, wherein: compressive stresses exhibited at respective parts of the panel on the outer panel surface of the panel in a state, in which the panel is assembled into a cathode ray tube, are determined to satisfy a condition of "$5.5\ \text{MPa} \leqq |\sigma| \leqq 12.5\ \text{MPa}$", where, "$\sigma$" represents the compressive stresses exhibited at respective parts of the panel.

Preferably, the compressive stress exhibited at a central part of the panel is determined to satisfy a condition of "$9.0\ \text{MPa} \leqq |\sigma_{C/C}| \leqq 12.5\ \text{MPa}$", where, "$\sigma_{C/C}$" represents the compressive stress exhibited at the central panel part. The compressive stress exhibited at a seal edge part of the panel is preferably determined to satisfy a condition of "$5.5\ \text{MPa} \leqq |\sigma_{S/E}| \leqq 8.5\ \text{MPa}$", where, "$\sigma_{S/E}$" represents the compressive stress exhibited at the seal edge panel part.

BRIEF DESCRIPTION OF THE DRAWINGS

The above objects, and other features and advantages of the present invention will become more apparent after a reading of the following detailed description when taken in conjunction with the drawings, in which:

FIGS. 2*a* and 2*b* are side views of panel structures applied to the cathode ray tube of FIG. 1, respectively, in which FIG. 2*a* illustrates a general panel structure having a certain radius of curvature at the outer surface thereof, and FIG. 2*b* illustrates a flat panel structure having an outer surface approximate to a complete flat surface;

FIGS. 3*a* and 3*b* are views respectively illustrating a flat panel to which the present invention is applied, in which FIG. 3*a* is a sectional view illustrating the cross section of the panel, and FIG. 3*b* is a perspective view illustrating compressive stresses exhibited at respective parts of the panel;

FIGS. 6*a* and 6*b* are views illustrating a measurement of membrane stresses exhibited at respective parts of the panel, to describe the principle of the present invention, in which FIG. 6*a* is a perspective view illustrating measurement positions for respective membrane stresses on the panel, and FIG. 6*b* is a graph depicting a membrane stress distribution depending on a degree of reinforcement.

DESCRIPTION OF THE PREFERRED EMBODIMENTS

Now, the present invention will be described in detail, with reference to FIGS. 1 to 6*b*.

Figure 3A:
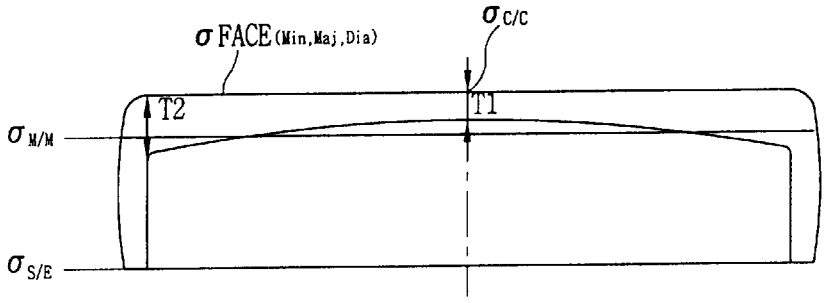
Figure 3B:
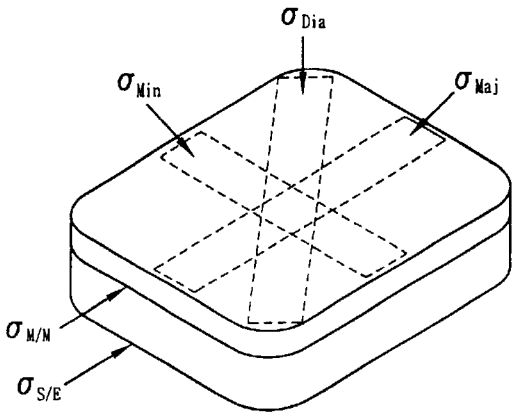
Figure 4A:
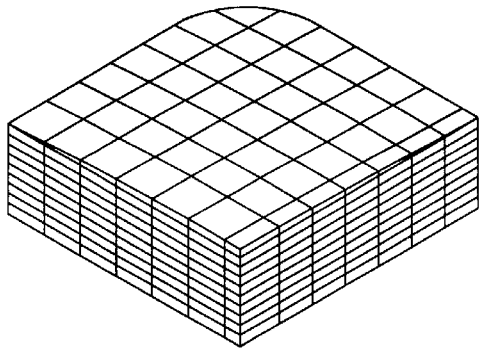
FIGS. 4*a* to 4*d* are views illustrating a maximum stress simulation depending on the thickness of the panel conducted for various panels, respectively, to describe the principle of the present invention.
Figure 4B:
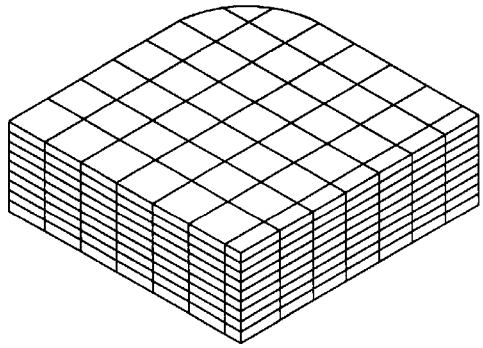
Figure 4C:
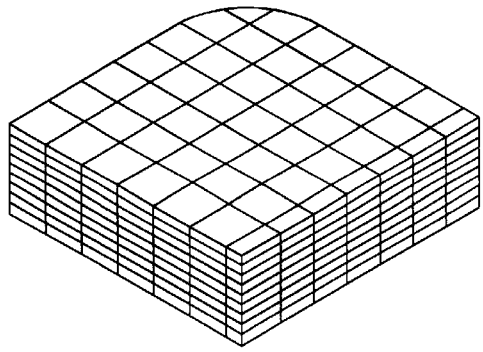
Figure 4D:
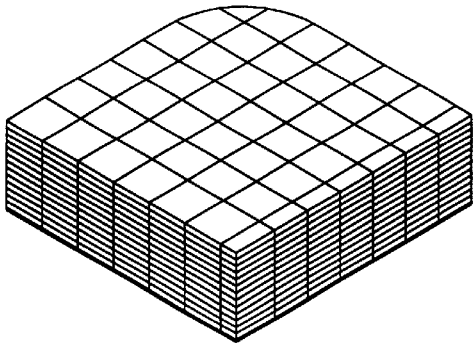

FIGS. 3*a* and 3*b* illustrate a flat panel associated with the present invention, respectively. FIG. 3*a* is a sectional view of the panel whereas FIG. 3*b* is a perspective view of the panel, illustrating compressive stress distributions at respective parts of the panel.

Figure 1:
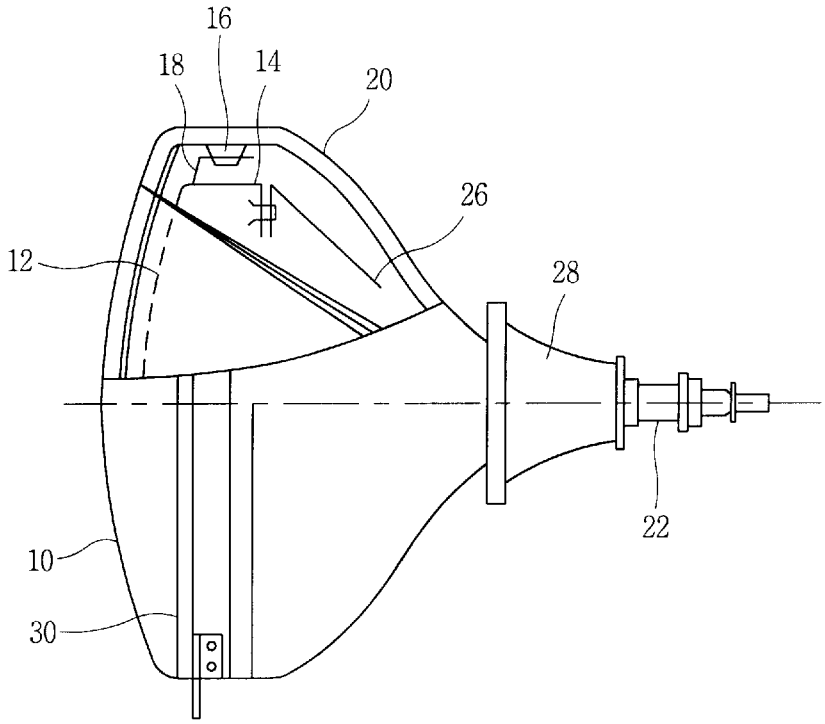
FIG. 1 CONVENTIONAL ART
FIG. 1 is a partially-broken side view schematically illustratinc the structure of a typical cathode ray tube.
Figure 2A:
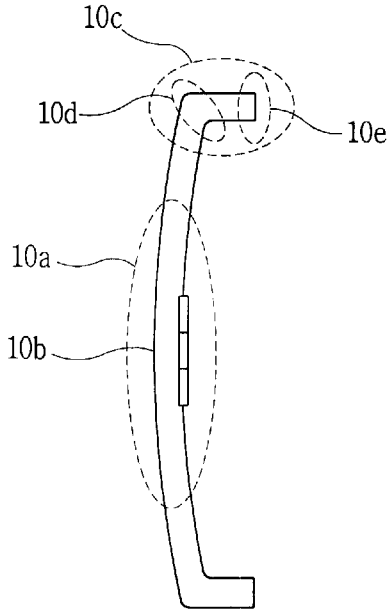
FIG. 2A CONVENTIONAL ART
Figure 2B:
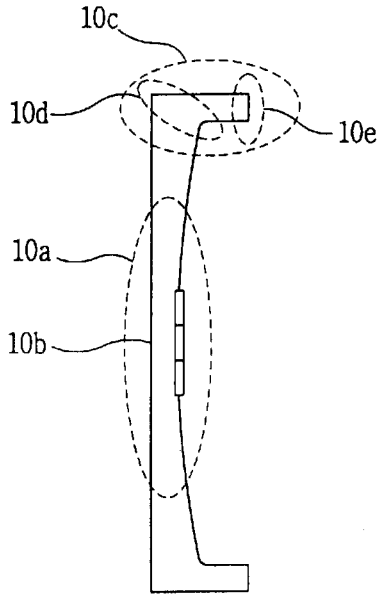
FIG. 2B CONVENTIONAL ART

The panel has a structure shown in FIG. 2*b*. As shown in FIG. 2*b*, the panel, which is denoted by the reference numeral 10, includes a face part 10*a* corresponding to an effective region for displaying an image, a central part 10*b* arranged at a central coordinate portion of the face part 10*a*, and a skirt part 10*c* arranged around the face part 10*a*. The skirt part 10*c* includes corner parts 10*d* and a seal edge part 10*e* coupled to a funnel which is denoted by the reference numeral 20 in FIG. 1.

In FIGS. 3*a* and 3*b*, "$\sigma_{C/C}$" represents a compressive stress applied to the central part 10*b* of the panel 10, "$\sigma_{Min}$", "$\sigma_{Maj}$", and "$\sigma_{Dia}$" represent compressive stresses applied to the face part 10*a* in short-side, long-side and diagonal directions, respectively, "$\sigma_{M/M}$" represents a compressive stress applied to a mold match line of the skirt part 10*c*, and "$\sigma_{S/E}$" represents a compressive stress applied to the seal edge part 10*e*. Also, "T1" represents the thickness of the central part 10*b* of the panel 10, and "T2" represents the thickness of each panel Corner part 10*d*. The thickness ratio of each panel corner part 10*d* to the central part 10*b*, T2/T1, is referred to as a "wedge rate".

The following Table 1 shows microsonic and drop characteristics of cathode ray tubes respectively using flat panels having different wedge rates "T2/T1". In Table 1, the C grade corresponds to a grade in which an electron beam can be accurately projected onto an associated portion of the fluorescent film at a speaker output of 23 Watts. The D grade corresponds to a grade in which an electron beam can be half projected onto an associated portion of the fluorescent film at the speaker output of 23 Watts. On the other hand, the E grade corresponds to a grade in which an electron beam cannot be projected onto an associated portion of the fluorescent film at the speaker output of 23 Watts.

TABLE 1

Microsonic and Drop Characteristics Depending on Wedge Rate (T2/T1)

| Wedge Rate | Microsonic Characteristics | Drop Characteristics |
|---|---|---|
| 170% Flat Panel | E-Grade | 15[G] |
| 180% Flat Panel | D-Grade | 18[G] |
| 200% Flat Panel | C-Grade | 26[G] |

Referring to the results shown in Table 1, it can be found that it is necessary to reinforce the microsonic and drop characteristics of a flat panel in the manufacture of a cathode ray tube using that flat panel. In pace with a tendency to provide a cathode ray tube with an increased size, speakers used in association with that cathode ray tube are typically required to have an increased output or an output similar to those of audio appliances. Due to such a high speaker output, a microsonic phenomenon may occur when the shadow mask 12 has a degraded strength. The shadow mask 12 may also be deformed due to such a degraded strength during a transportation thereof, thereby resulting in a degradation in quality. For this reason, it is necessary to design a panel capable of satisfying requirements given in set makers.

Meanwhile, during a fabrication of the panel 10, a distribution of compressive stresses is exhibited in the panel 10 in such a fashion that the panel 10 is subjected to a maximum stress at the central part 10*b* thereof while being subjected to a stress gradually decreasing toward the skirt part 10*c*. Referring to such a stress distribution, it can found that each corner part 10*d* of the panel 10 arranged adjacent to the skirt part 10*c* is a region where a reduced stress is exhibited.

In particular, a relatively small compressive stress is exhibited at parts of the panel 10 arranged at diagonal ends of the surface part 10*a*, that is, the corner parts 10*d* arranged adjacent to the skirt part 10*c*. Furthermore, an instable cooling is conducted at those parts corresponding to the corner parts 10*d* because the panel 10 has a very large thickness at those parts, as compared to that of the central part 10*b*. A very non-uniform temperature distribution is also formed at those parts.

Now, the present invention will be described in detail, in conjunction with examples of tests and examples conducted based on the results of the tests.

Figure 5:
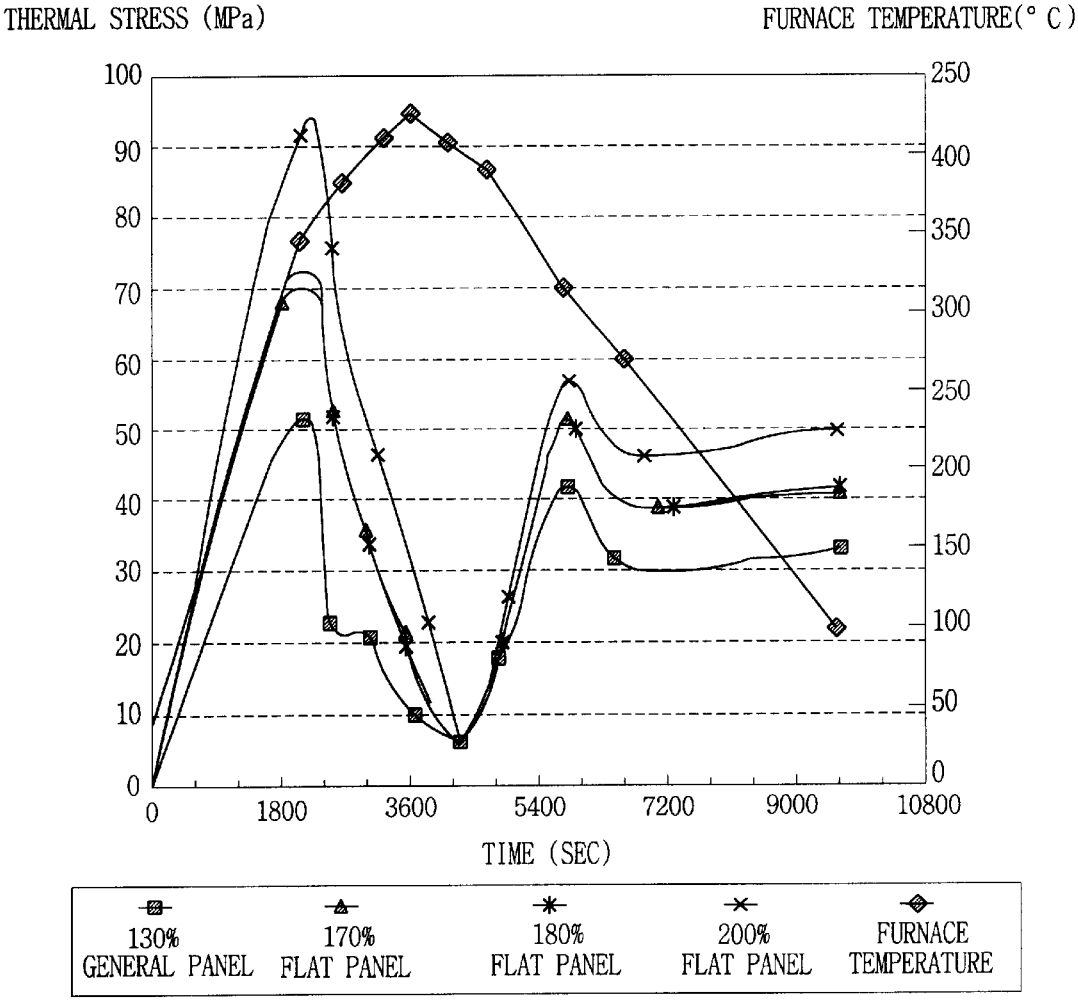
FIG. 5 is a graph depicting results of a thermal stress simulation depending on a variation in the internal temperature of a furnace used, to describe the principle of the present invention.

Test 1: Test for measuring an in-furnace breakage depending on a panel thickness A simulation for a variation in stress depending on the thickness of a panel was conducted for various panels, respectively. FIGS. 4*a* to 4*d* correspond to a maximum stress simulation depending the thickness of a panel, respectively. FIG. 5 corresponds to a thermal stress simulation depending on a variation in the internal temperature of a furnace used.

Referring to FIGS. 4*a* to 4*d*, it can be found that an increase in maximum stress is exhibited as the wedge rate of either a general panel or a flat panel increases. Referring to FIG. 5, it can be found that a maximum thermal stress is exhibited in all panel models in a temperature interval where an abrupt temperature increase occurs.

As shown in FIGS. 4*a* to 4*d*, each panel model exhibits a maximum stress at the corner parts 10*d* thereof having a maximum panel thickness. When the panel models are compared together in terms of the maximum stress, it can be found that a flat panel, in which the panel corner part 10*d* thereof has a largest thickness, as compared to those of other panel models, that is, which has a wedge rate of 200%, exhibits an in-furnace breakage rate increased by 29% from that of a flat panel having a wedge rate of 170% while being increased by 78% from a general panel having a wedge rate of 130%.

TABLE 2

In-Furnace Breakage Rate Depending on Wedge Rate (T2/T1)

| Wedge Rate | Number of Samples | Breakage Rate |
|---|---|---|
| 170% Flat Panel | 34,852 | 1.63% |
| 200% Flat Panel | 1.63% | 6.03% |

Referring to the above Table 2, it can be found that the in-furnace breakage rate of the flat panel having a wedge rate of 200% is very higher than that of the flat panel having a wedge rate of 170%, by 370%. As apparent from the relation between the panel thickness and the breakage rate, this fact means that a thermal stress increases at a very high rate, depending on an increase in panel thickness difference, and that such a high thermal stress increase may excess a critical value resulting in a panel breakage.

That is, there is a geometric progression relation between the thermal stress and the panel thickness, that is, the glass thickness, as expressed by the following Expression 1:

$$\text{Thermal Stress } k\cdot(\text{Glass Thickness})^n \quad \text{[Expression 1]}$$

where, k is a constant.

When there is a high thickness difference, that is, a high wedge rate, among the different parts of the panel, it results in a difference among those panel parts in terms of a thermal transfer rate. As a result, there is a temperature difference among the different panel parts. Due to such a temperature difference, a torsion is generated. In particular, it is important for diagonal corner parts to be controlled in thickness. This is because the diagonal corner parts exhibit a maximum wedge rate.

The following Table 3 shows results obtained after measuring the breakage rate of each panel model depending on the wedge rate.

TABLE 3

Breakage Rate of Each Model Depending on Wedge Rate

| Model | T1 | T2 | Wedge Rate | Breakage Rate |
|---|---|---|---|---|
| 25" Flat Panel | 13 mm | 26 mm | 200% | 0.78% |
| 29" Flat Panel | 14.5 mm | 29 mm | 200% | 4.20% |
| 32" Wide Flat Panel | 14 mm | 32 mm | 230% | 11.90% |

Referring to Table 3, it can be found that the thickness T1 of the central part 10*b* is determined to be minimum in so far as it ensures a security against an explosion (breakage), and that the breakage rate is greatly increased in accordance with an increase in the thickness T2 of the diagonal corner parts 10*d*.

Based on the results shown in Table 3, it is preferred that a thickness ratio of the thickness of each diagonal corner part to the thickness of the central part, T2/T1, satisfies a condition of "$1.7 \leqq T2/T1 \leqq 2.3$".

Test 2: Test for measuring an in-furnace breakage depending on a reinforcement or a non-reinforcement Measurement of a compressive stress resulting from a reinforcement may be achieved using two methods. One method is to carry out the compressive stress measurement for a panel manufactured to be assembled in a cathode ray tube. The other method is to carried out the compressive stress measurement for the panel in a state separated from the cathode ray tube.

The in-furnace breakage test was conducted for both the cases in which a compressive stress is optionally applied, that is, the reinforced case, and the case in which no compressive stress is applied, that is, the non-reinforced case. The results of the test are shown in Tables 4 and 5.

TABLE 4

Data about In-Furnace Breakage Rate Depending on Reinforcement at Respective Parts of Panel

| Reinforcement | $\sigma_{C/C}$ (MPa) | $\sigma_{Min}$ (MPa) | $\sigma_{Mni}$ (MPa) | $\sigma_{Dia}$ (MPa) | $\sigma_{S/E}$ (MPa) | Number of Samples | Breakage Rate |
|---|---|---|---|---|---|---|---|
| Yes | 15.0 | 9.0 | 7.0 | 8.0 | 7.0 | 7,519 | 3.84% |
| No | 2.3 | 1.8 | 1.8 | 1.2 | 5.9 | 7,973 | 10.51% |

TABLE 5

Data about Breakage Rate Depending on Reinforcement, Associated with Various Furnaces

| Reinforcement | Number of Samples | Stabi Furnace | B/K Furnace | F/S Furnace | Exhaust Furnace |
|---|---|---|---|---|---|
| Yes | 7,519 | 1.02% | 1.85% | 0.56% | 0.51% |
| No | 7,973 | 3.54% | 3.43% | 1.04% | 2.97% |

Table 4 shows the test results respectively obtained in the reinforced and non-reinforced states. Specifically, Table 4 describes results obtained after measuring stresses at respective cross-sectional parts of the panel sectioned as shown in FIG. 3*b*, that is, section stresses, along with data about the in-furnace breakage of the panel respectively exhibited in various furnaces.

The "non-reinforced" case corresponds to the case in which the panel is manufactured in accordance with a manufacturing method involving a slow cooling process. In this case, a reduced breakage rate is exhibited at a particular panel region (that is, an outer panel surface point from which each diagonal corner part extends) because the entire stress difference is very stable. However, where the weight of the panel is increased, and the thickness of the corner parts 10*b* is highly increased, as compared to that of the central part 10*b*, an increased breakage rate is exhibited in association with a knocking breakage resulting from external impact generated during the manufacture of the cathode ray tube, a breakage resulting from fine defects generated during the manufacture of the panel, and a breakage resulting from scratches formed on the outer surfaces of the face part 10*a* and the seal edge part 10*e* sealed along with the funnel 20. Referring to Table 5, it can be found that a high breakage rate is exhibited in association with all furnaces. Typically, the breakage resulting from defects may occur even at a low tensile stress. In the case of flat panels, a breakage may result from very fine defects.

Based on the above mentioned results, it is concluded that a careful management of compressive stresses at the outer surface of the panel should be made in order to solve the above mentioned problems.

On the other hand, the "reinforced" case corresponds to the case in which the panel is manufactured under the condition of applying a high compressive stress throughout the panel. In this case, it can be found that the panel is prevented, by virtue of an outer compressive stress layer thereof, from a knocking breakage resulting from external impact generated during the manufacture of the cathode ray tube, a breakage resulting from fine defects generated during the manufacture of the panel, and a breakage resulting from scratches formed on the outer surfaces of the face part 10*a* and the seal edge part 10*e* sealed along with the funnel 20. That is, the breakage rate of the panel is greatly reduced.

However, the uniformity of the stress distribution in the panel is degraded, thereby resulting in an abrupt increase in breakage at a particular panel region (that is, an outer panel surface point from which each diagonal corner part extends). This breakage corresponds to 80% or more of the entire breakage.

Where a compressive stress is optionally applied, accordingly, it is necessary to control stress distributions in a panel thickness direction (associated with section stresses) and a panel face direction (associated with membrane stresses). In particular, it is necessary to preferentially manage the section stresses in association with the surface knocking breakage resulting from external impact generated during the manufacture of the cathode ray tube, while preferentially managing the membrane stresses in association with a thermal breakage resulting from the furnace used.

Typically, respective section stresses are measured at particular positions. That is, "$\sigma_{C/C}$" is measured at the central part 10*b*, and typically for a sample of 120 mm×40 mm cut from the central part 10*b*. "$\sigma_{Min}$", "$\sigma_{Maj}$", and "$\sigma_{Dia}$" are measured at positions respectively spaced apart in short-side, long-side and diagonal directions from associated ends of an effective screen by a distance of 20 to 30 mm toward the position associated with "$\sigma_{C/C}$" typically for samples cut from the face part 10*a to have a width of* 13 to 15 mm. On the other hand, "$\sigma_{S/E}$" is measured at a position corresponding to an end of the seal edge part 10*e*, typically for a sample cut from the seal edge part 10*e to have a width of* 13 to 15 mm. "$\sigma_{M/M}$" is measured at a position spaced apart from the mold match line of the skirt part 10*c by a distance of* 20 to 30 mm toward the position associated with "$\sigma_{S/E}$", typically for a sample cut from the skirt part 10*c* to have a thickness of 13 to 15 mm.

Based on relations determined in accordance with the above mentioned tests, examples of a test for measuring an in-furnace breakage depending on compressive stresses were conducted.

EXAMPLE 1

Figure 6A:
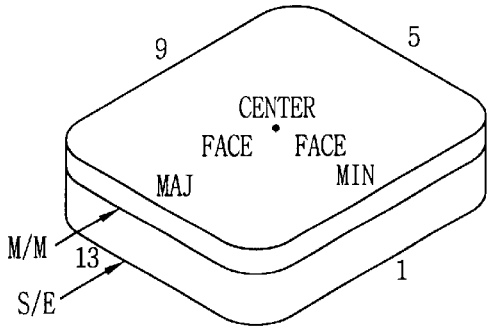
Figure 6B:
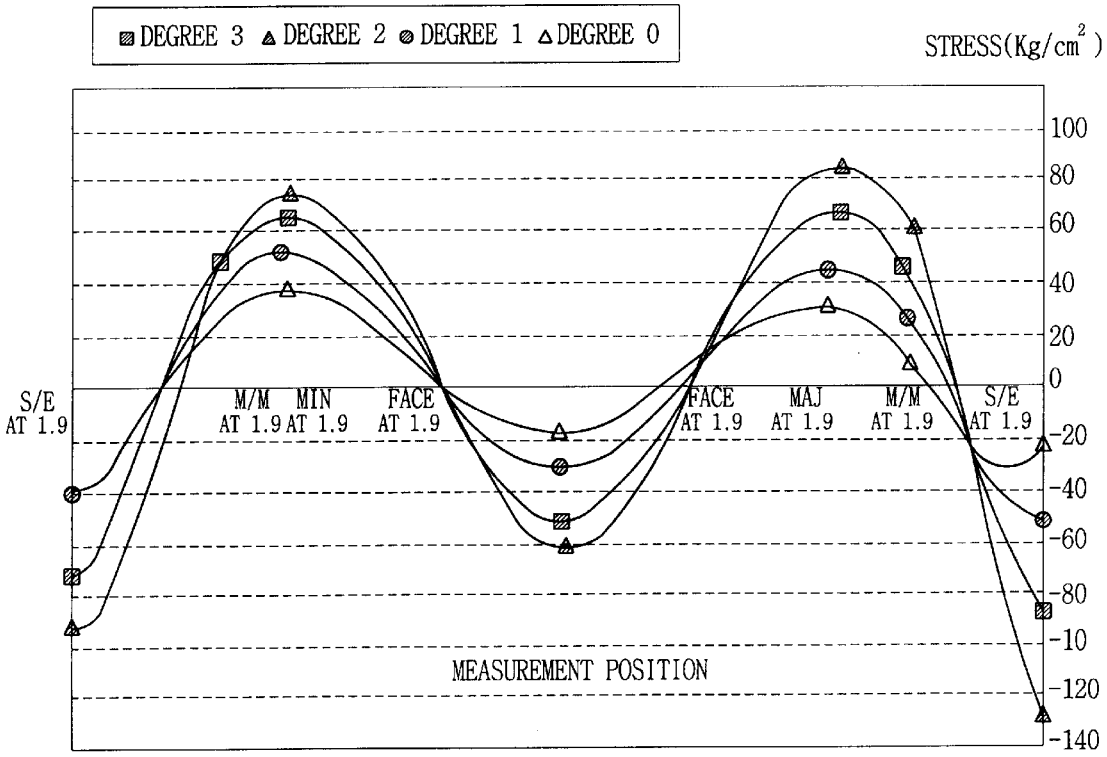

Test for Determining an In-furnace Breakage Depending on a Degree of Reinforcement in a Panel State This example describes the relation of an in-furnace breakage depending on a degree of reinforcement in a panel state, using results of a simulation for a membrane stress distribution in each product respectively illustrated in FIGS. 6*a* and 6*b*. FIG. 6*a* illustrates panel positions where membrane stresses are measured, respectively. FIG. 6*b* is a graph depicting a membrane stress distribution depending on a degree of reinforcement at each position of FIG. 6*a*.

The following Tables 6 and 7 show results respectively obtained after a test for measuring an in-furnace breakage depending on a degree of reinforcement. Table 6 describes data about an in-furnace breakage exhibited in the same furnace depending on a degree of reinforcement. Table 7 describes comparison data about respective in-furnace breakages exhibited in various furnace depending on a degree of reinforcement.

In Tables 6 and 7, the reinforcement degree 3 is membrane compressive stress at various portions and breakage rate thereof and corresponds to a section stress of 16 MPa or more, the reinforcement degree 2 is membrane compressive stress at various portions and breakage rate thereof and corresponds to a section stress of 10 to 15 MPa, the reinforcement degree 1 is membrane compressive stress at various portions and breakage rate thereof and corresponds to a section stress of 6 to 9 MPa, and the reinforcement degree 0 is membrane compressive stress at various portions and breakage rate thereof and corresponds to a section stress of 5 MPa or less.

TABLE 6

Data about In-Furnace Breakage Rate Depending on Degree of Reinforcement (Unit: [kg/cm$^2$])

| Degree of Reinforcement | $\sigma_{C/C}$ | $\sigma_{Min}\sigma_{Maj}$ | $\sigma_{M/M}$ | $\sigma_{S/E}$ | Breakage Rate |
|---|---|---|---|---|---|
| Degree 3 | 60.3 | 76~82 | 46~60 | 92~124 | 3.84% |
| Degree 2 | 51 | 63~68 | 30~40 | 74~86 | 1.50% |
| Degree 1 | 32.5 | 41~49 | 18~27 | 40~57 | 1.30% |
| Degree 0 | 17 | 30~35 | 10~20 | 38~40 | 2.50% |

The data described in Table 6 represents results obtained after measuring membrane stresses in a panel having a 29" flat panel structure. Measurement positions correspond to those for section stresses, respectively.

TABLE 7

Comparison Data about Breakage Rate Depending on Degree of Reinforcement, Associated with Various Furnaces

| Degree of Reinforcement | Number of Samples | Stabi Furnace | B/K Furnace | F/S Furnace | Exhaust Furnace |
|---|---|---|---|---|---|
| Degree 3 | 7,937 | 1.02% | 1.84% | 0.51% | 0.46% |
| Degree 2 | 102,681 | 0.43% | 0.66% | 0.17% | 0.29% |
| Degree 1 | 19,420 | 0.43% | 0.45% | 0.15% | 0.30% |
| Degree 0 | 13,392 | 0.82% | 0.93% | 0.33% | 0.43% |

Referring to Tables 6 and 7, it can be found that in the case of the reinforcement degree 3, the knocking breakage generated at the outer surface of the panel due to external impact during the manufacture of the cathode ray tube is greatly reduced because the degree of reinforcement is very high. However, a stress concentration occurs at the diagonal corner parts. Furthermore, the stress distribution in the whole part of the panel is very non-uniform. As a result, a concentrated thermal breakage is generated at particular regions, that is, outer panel surface points from which respective diagonal corner parts extend. An increased generation rate of thermal breakage is exhibited in the cases of the Stabi furnace and B/K furnace.

On the other hand, the cases of the reinforcement degrees 2 and 1 exhibit an improvement in the stress distribution in the whole part of the panel in terms of a uniformity by virtue of an optimum reinforced state given by the reinforcement degrees 2 and 1, even though the knocking breakage generated at the outer surface of the panel due to external impact during the manufacture of the cathode ray tube is similar to that of the reinforcement degree 3. As a result, a minimum in-furnace thermal breakage occurs.

In the case of the reinforcement degree 0, an increased breakage is exhibited in association with a knocking breakage resulting from external impact generated during the manufacture of the cathode ray tube and a breakage resulting from scratches formed on the outer surfaces of the face and seal edge parts, because of a very low reinforcement degree. In this case, the stresses at the diagonal corner parts are reduced, so that the breakage at each diagonal corner part starting point is exhibited at a rate corresponding to an intermediate rate between that of the reinforcement degrees 3 and 2, in association with the cases of the Stabi furnace and B/K furnace.

Based on the above mentioned results, it can be found that in the case of a flat panel structure having an average radius of curvature corresponding to 50,000 mm or more at an outer surface thereof while having a desired radius of curvature at an inner surface thereof, a reduction in breakage rate is obtained when the compressive stress at the outer panel surface, that is, the section stress, satisfies a condition of "6.0 MPa≦σ≦15.0 MPa", preferably a condition of "6.0 MPa≦σ≦12.0 MPa" and when the membrane stress ranges from 30 kg/cm$^2$ to 90 kg/cm$^2$. The stress values described in Table 6 represent membrane stresses. Generally, a compressive stress represents only a section stress because the measured value of a membrane stress varies depending on the thickness of an associated panel.

EXAMPLE 2

Test for Determining an In-furnace Breakage Depending on a Degree of Reinforcement After the Manufacture of the Cathode Ray Tube This example describes results obtained after measuring an in-furnace breakage depending on compressive stresses, that is, section stresses, generated in a panel, which has the same condition as that used in Example 1, after the manufacture of a cathode ray tube using the panel. The results are described in the following Table 8.

TABLE 8

Data about In-Furnace Breakage Rate Depending on Degree of Reinforcement

| Degree of Reinforcement | $\sigma_{C/C}$ | $\sigma_{S/E}$ | Breakage Rate |
|---|---|---|---|
| Degree 3 | 14.5 MPa | 9.8 Mpa | 3.84% |
| Degree 2 | 11.5 MPa | 7.6 Mpa | 1.50% |
| Degree 1 | 9.7 MPa | 5.8 Mpa | 1.30% |
| Degree 0 | 6.4 MPa | 3.2 MPa | 2.50% |

The data described in Table 8 represents results obtained after measuring section stresses in a panel having a 29" flat panel structure.

Referring to Table 8, it can be found that the results of Table 8 are identical or similar to those of Example 1, that is, the results obtained after the test for determining an in-furnace breakage depending on a degree of reinforcement in a panel state.

In the case of the reinforcement degree 3, the knocking breakage generated at the outer surface of the panel due to external impact during the manufacture or the cathode ray tube is greatly reduced because the degree of reinforcement is very high. However, a stress concentration occurs at the diagonal corner parts. Furthermore, the stress distribution in the whole part of the panel is very non-uniform. As a result, a concentrated thermal breakage is generated at particular regions, that is, outer panel surface points from which respective diagonal corner parts extend. An increased generation rate of thermal breakage is exhibited in the cases of the Stabi furnace and B/K furnace.

On the other hand, the cases of the reinforcement degrees 2 and 1 exhibit an improvement in the stress distribution in the whole part of the panel in terms of a uniformity by virtue of an optimum reinforced state given by the reinforcement degrees 2 and 1, even though the knocking breakage generated at the outer surface of the panel due to external impact during the manufacture of the cathode ray tube is similar to that of the reinforcement degree 3. As a result, a minimum in-furnace thermal breakage occurs.

In the case of the reinforcement degree 0, an increased breakage is exhibited in association with a knocking breakage resulting from external impact generated during the manufacture of the cathode ray tube and a breakage resulting from scratches formed on the outer surfaces of the face and seal edge parts, because of a very low reinforcement degree. In this case, the stresses at the diagonal corner parts are reduced, so that the breakage at each diagonal corner part starting point is exhibited at a rate corresponding to an intermediate rate between that of the reinforcement degrees 3 and 2, in association with the cases of the Stabi furnace and B/K furnace.

Based on the above mentioned results of Table 8, it can be found that where a cathode ray tube is manufactured using a panel having an average radius of curvature corresponding to 50,000 mm or more at an outer surface thereof while having a desired radius of curvature at an inner surface thereof, a reduction in breakage rate is obtained when the compressive stress at the outer panel surface, that is, the section stress, satisfies a condition of "5.5 MPa≦σ≦12.5 MPa".

As apparent from Examples 1 and 2, results advantageous to a reduction in breakage are not always obtained, even though a high compressive stress is applied. In order to solve this problem, it is essential to provide an optimum section stress distribution and an optimum membrane stress distribution. Although the membrane stress varies depending on a wedge rate of the panel, that is, a thickness difference, the optimum membrane stress distribution may be determined using optimum values as described in Table 6 in association with the reinforcement degrees 2 and 1.

As apparent from the above description, the present invention provides a display panel for a cathode ray tube which has a flat panel structure having an average radius of curvature corresponding to 50,000 mm or more, approximate to that of a flat surface, at an outer surface thereof while having a desired radius of curvature at an inner surface thereof, in which a compressive stress structure designed to minimize a panel breakage resulting from an in-furnace thermal impact applied to the cathode ray tube while obtaining a maximum strength for a shadow mask is optionally varied to achieve an improvement in an initial breakage rate of the panel. By virtue of this improvement, it is possible to maximize the productivity while reducing the manufacturing costs. Accordingly, an enhanced competitiveness is obtained.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A structure of a panel for a flat type cathode ray tube having an outer panel surface approximating a substantially flat surface, and an inner panel surface with a radius of curvature, wherein:

a difference between a panel thickness at a central part of the panel and a panel thickness at each of the diagonal corner parts of the panel satisfies a condition of 1.7≦T2/T1≦2.2, where T1 represents the panel thickness at the central panel part, and T2 represents the panel thickness at the diagonal corner panel parts; and compressive stresses exhibited at at least one part of the outer panel surface, at the central part of the panel, and at a seal edge part of the panel respectively satisfy a condition of 6.0 MPa≦|σ|≦15.0 MPa, 10.0 MPa≦$|\sigma_{C/C}|$≦15.0 MPa, and 6.0 MPa≦$|\sigma_{S/E}|$≦9.0 MPa, where σ represents the compressive stresses exhibited at the at least one part of the outer panel surface, $\sigma_{C/C}$' represents the compressive stress exhibited at the central part of the panel, and $\sigma_{S/E}$ represents the compressive stress exhibited at the seal edge part of the panel.

2. The display panel according to claim 1, wherein among the compressive stresses, that exhibited at the central panel part is determined to satisfy a condition of "10.0 MPa≦$|\sigma_{C/C}|$≦15.0 MPa", where, "$\sigma_{C/C}$" represents the compressive stress exhibited at the central panel part.

3. The display panel according to claim 1, wherein among the compressive stresses, that exhibited at a seal edge part of the panel is determined to satisfy a condition of "6.0 MPa≦$|\sigma_{S/E}|$≦9.0 Pa", where, "$\sigma_{S/E}$" represents the compressive stress exhibited at the seal edge panel part.

4. A structure of a panel for a flat type cathode ray tube having an outer panel surface approximating a substantially flat surface, and an inner panel surface with a radius of curvature, wherein:

compressive stresses exhibited at at least one part of the outer surface, at the central part of the panel, and at a seal edge part of the panel, in a state in which the panel is assembled into a cathode ray tube, respectively satisfy a condition of 5.5 MPa≦|≦σ|12.5 MPa, 9.0 MPa≦$|\sigma_{C/C}|$≦12.5 MPa, and 5.5 MPa≦$|\sigma_{S/E}|$≦8.5 MPa, where a represents the compressive stresses exhibited at the at least one part of the panel, $\sigma_{C/C}$ represents the compressive stress exhibited at the central panel part, and $\sigma_{S/E}$ represents the compressive stress exhibited at the seal edge panel part.

5. The display panel according to claim 4, wherein among the compressive stresses, that exhibited at a central part of the panel is determined to satisfy a condition of "9.0 MPa≦$|\sigma_{C/C}|$≦12.5 MPa", where, "$\sigma_{C/C}$" represents the compressive stress exhibited at the central panel part.

6. The display panel according to claim 4, wherein among the compressive stresses, that exhibited at a seal edge part of the panel is determined to satisfy a condition of "5.5 MPa≦$|\sigma_{S/E}|$≦8.5 MPa", where, "$\sigma_{S/E}$" represents the compressive stress exhibited at the seal edge panel part.

7. A flat type cathode ray tube comprising the structure of claim 1.

8. A flat type cathode ray tube comprising the structure of claim 4.

9. An improved display panel for a flat type cathode ray tube having an outer panel surface approximating a substantially flat surface, and an inner panel surface with a radius of curvature, the improvement comprising:

a difference between a panel thickness at a central part of the panel and a panel thickness at each of diagonal corner parts of the panel satisfies the following equation:

$$1.7 \leqq T2/T1 \leqq 2.2$$

where T1 represents the panel thickness at the central panel part, and T2 represents the panel thickness at each of the diagonal corner parts; and compressive stresses exhibited at at least one part of the outer panel surface, at the central part of the panel, and at a seal edge part of the panel respectively satisfy the following equations:

$$6.0\ \text{MPa} \leqq |\sigma| \leqq 15.0\ \text{MPa}$$

$$10.0\ \text{MPa} \leqq |\sigma_{C/C}| \leqq 15.0\ \text{MPa}$$

$$6.0\ \text{MPa} \leqq |\sigma_{S/E}| \leqq 9.0\ \text{MPa}$$

where σ represents the compressive stresses exhibited at the at least one part of the outer panel surface, $\sigma_{C/C}$ represents the compressive stress exhibited at the central part of the panel, and $\sigma_{S/E}$ represents the compressive stress exhibited at the seal edge part of the panel.

10. A flat type cathode ray tube comprising the structure of claim 9.

11. The improved display panel for a flat type cathode ray tube having an outer panel surface approximating a substantially flat surface, and an inner panel surface with a radius of curvature, the improvement comprising:

compressive stresses exhibited at at least one part of the outer surface, at the central part of the panel, and at a seal edge part of the panel, when the panel is assembled into a cathode ray tube, satisfy the following equations:

$$5.5\ \text{MPa} \leqq |\sigma| \leqq 12.5\ \text{MPa}$$

$$9.0\ \text{MPa} \leqq |\sigma_{C/C}| \leqq 12.5\ \text{MPa}$$

$$5.5\ \text{MPa} \leqq |\sigma_{S/E}| \leqq 8.5\ \text{MPa}$$

where σ represents the compressive stresses exhibited at the at least one part of the panel, $\sigma_{C/C}$ represents the compressive stress exhibited at the central part of the panel, and a $\sigma_{S/E}$ represents the compressive stress exhibited at the seal edge part of the panel.

12. A flat type cathode ray tube comprising the structure of claim 11.

13. An improved display panel for a cathode ray tube having a panel with a substantially flat outer surface and an inner surface having a radius of curvature, the improvement comprising:

a difference between a panel thickness at a central portion of the panel and a panel thickness at each of diagonal corner portions of the panel satisfies the following equation:

$$1.7 \leqq T2/T1 \leqq 2.2$$

where T1 represents the panel thickness at the central portion of the panel, and T2 represents the panel thickness at each of the diagonal corner portions of the panel.

14. The improved display panel according to claim 13, wherein compressive stresses exhibited at the outer surface of the panel satisfy the following equation:

$$6.0\ \text{MPa} \leqq |\sigma| \leqq 15.0\ \text{MPa}$$

where σ represents the compressive stress exhibited at the outer surface of the panel.

15. The improved display panel according to claim 13, wherein the compressive stress exhibited at the central portion of the panel satisfies the following equation:

$$10.0\ \text{MPa} \leqq |\sigma_{C/C}| \leqq 15.0\ \text{MPa}$$

where $\sigma_{C/C}$ represents the compressive stress exhibited at the central portion of the panel.

16. The display panel according to claim 13, wherein the compressive stress exhibited at a seal edge portion of the panel satisfies the following equation:

$$6.0\ \text{MPa} \leqq |\sigma_{S/E}| \leqq 9.0\ \text{MPa}$$

where $\sigma_{S/E}$ represents the compressive stress exhibited at the seal edge portion of the panel.

17. The improved display panel according to claim 14, wherein compressive stresses exhibited at the outer surface of the panel, in a state in which the panel is assembled into a cathode ray tube, satisfy the following equation:

$$5.5\ \text{MPa} \leqq |\sigma| \leqq 12.5\ \text{MPa}$$

where $\sigma$ represents the compressive stresses exhibited at the outer surface of the panel.

18. The improved display panel according to claim 17, wherein the compressive stress exhibited at a central portion of the panel satisfies the following equation:

$$9.0\ \text{MPa} \leqq |\sigma_{C/C}| \leqq 12.5\ \text{MPa}$$

where $\sigma_{C/C}$ represents the compressive stress exhibited at the central portion of the panel.

19. The improved panel according to claim 17, wherein the compressive stress at a seal edge portion of the panel satisfies the following equation:

$$5.5\ \text{MPa} \leqq |\sigma_{S/E}| \leqq 8.5\ \text{MPa}$$

where $\sigma_{S/E}$ represents the compressive stress exhibited at the seal edge portion of the panel.

20. A flat type cathode ray tube comprising the structure of claim 13.

* * * * *